US007322347B2

(12) United States Patent
Broersma

(10) Patent No.: US 7,322,347 B2
(45) Date of Patent: Jan. 29, 2008

(54) ADJUSTABLE CAPACITY LOADER FOR PAINTBALL MARKERS

(75) Inventor: Lester V. Broersma, San Diego, CA (US)

(73) Assignee: JT USA, LLC, Bentonville, AR (US)

( * ) Notice: Subject to any disclaimer, the term of this patent is extended or adjusted under 35 U.S.C. 154(b) by 518 days.

(21) Appl. No.: 10/931,930

(22) Filed: Aug. 31, 2004

(65) Prior Publication Data

US 2006/0042614 A1 Mar. 2, 2006

(51) Int. Cl.
*F41B 11/02* (2006.01)

(52) U.S. Cl. ..... 124/49; 124/51.1

(58) Field of Classification Search ..... 124/45, 124/49, 51.1, 52, 73, 74
See application file for complete search history.

(56) References Cited

U.S. PATENT DOCUMENTS 5,282,454 A * 2/1994 Bell et al. ..... 124/49
5,791,325 A * 8/1998 Anderson ..... 124/56
5,794,606 A * 8/1998 Deak ..... 124/51.1
5,816,232 A * 10/1998 Bell ..... 124/51.1
6,273,079 B1 * 8/2001 Jzn ..... 124/49
6,374,819 B1 * 4/2002 Ming-Hsien ..... 124/49
6,415,781 B1 * 7/2002 Perrone ..... 124/51.1
6,418,919 B1 * 7/2002 Perrone ..... 124/49
6,588,412 B2 * 7/2003 Ferrara et al. ..... 124/49
6,644,293 B2 * 11/2003 Jong ..... 124/52
7,017,569 B2 * 3/2006 Jong ..... 124/52

* cited by examiner

*Primary Examiner*—John A. Ricci
(74) *Attorney, Agent, or Firm*—Keisling Pieper & Scott PLC; David B. Pieper; Trent C. Keisling

(57) ABSTRACT

Each one of a set of substitutable paintball magazines of different capacities can be quickly mounted on a universal coupling base plugged into the projectile feeding port of a paintball marker. The coupling base incorporates a motor whose shaft connects to a paintball agitator within the magazine. The set of magazines offers a convenient selection of loading capacities to accommodate a variety of game circumstances and environments.

19 Claims, 3 Drawing Sheets

ADJUSTABLE CAPACITY LOADER FOR PAINTBALL MARKERS

FIELD OF THE INVENTION

This invention relates to ammunition magazines and more specifically to magazines for dispensing uniformly-sized spherical projectiles such as frangible paintballs into a gun adapted to shoot said projectiles.

BACKGROUND OF THE INVENTION pneumatically-operated projectile launching devices such as paintball guns, also called paintball markers, have been enhanced to provide a rapid and sustained firing of a large quantity of projectiles. One of such devices is disclosed in U.S. Pat. No. 6,474,326 Smith et al. Large capacity projectile loading and feeding hoppers and magazines are provided to mount above the feeding port of the gun positioned above the breech section. Such a holding and loading magazine is disclosed in U.S. Pat. No. 6,725,852 Yokota et al. Some projectile loading and feeding implements combine a hopper mounted on the feeding port of the gun and a loading magazine adapted to dump its contents into the hopper as disclosed in U.S. Pat. No. 5,809,983 Stoneking. The aforesaid three patents are incorporated in this specification by this reference.

During a paintball game, the amount of ammunition that a player uses depends upon his tactical role. A first line attacker must display great mobility with only occasional firing of the gun. By contrast, a rear shooter covering the advance of the attackers must use a great deal of ammunition through constant firing. Equipping all guns with the same size magazine entails risk of burdening a mobile attacker or limiting the firing ability of the rear soldier having a less offensive role.

The instant invention results from an attempt to resolve without compromise, the ammunition needs of a variety of game players.

SUMMARY OF THE INVENTION

The principal and secondary objects of this invention are to provide a convenient way to equip each player in a paintball game with the right amount of ammunition without unduly burdening some or limiting the fire power of other players, and to assure a quick and easy adaptation of a gun to the particular war game assignment of its user.

These and other valuable objects are achieved by an ammunition feeding device that can accommodate a number of magazines of different projectile-holding capacities. The device comprises a coupling base adapted for mounting directly into the projectile feeding port of a paintball marker. The coupling base has an intake port shaped and dimensioned to mate with the exit spout of each of a plurality of different capacity magazines. The base also includes a motor whose shaft interfaces with the connection bushing of an agitator located inside the magazine, when the magazine is installed on the coupling base.

DESCRIPTION OF THE PREFERRED EMBODIMENT OF THE INVENTION

Figure 1:
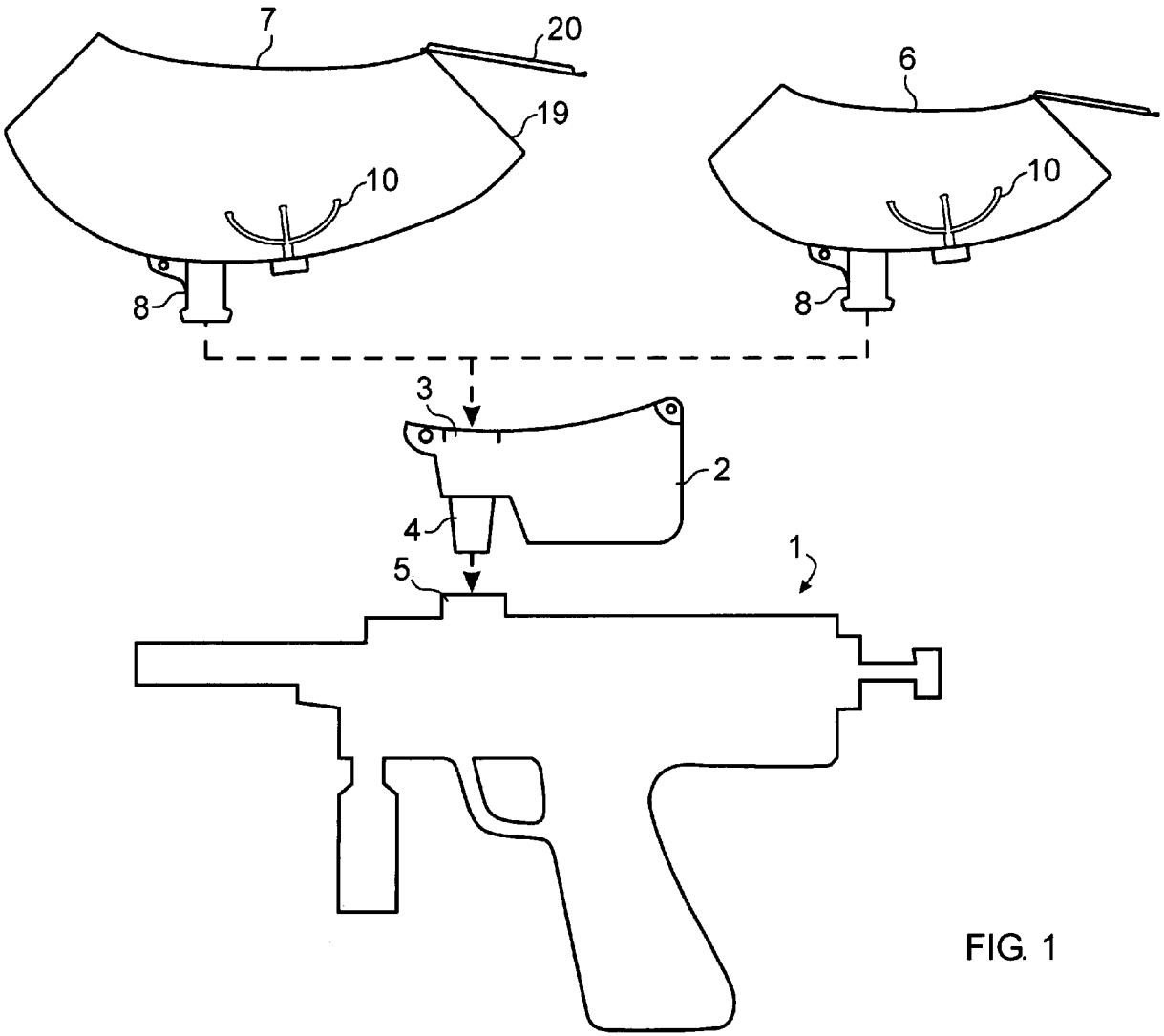
FIG. 1 is a schematic illustration of the projectile holding and feeding device in combination with a paintball marker.

Referring now to the drawing, there is shown in FIG. 1, a paintball gun or marker of the type disclosed in the first-mentioned of the above-referenced patents, in combination with a coupling base that can admit paintballs through its intake port 3, and feed them through an outlet 4 into the paintball feeding port 5 of the gun. Two or more paintball magazines 6, 7 of different capacities have a similarly shaped and dimensioned exit spout 8 that can be conveniently inserted into the intake port 3 of the coupling base 2. The outlet 4 of the coupling base and the exit spouts 8 of the magazines are shaped to tightly and securely mate with the gun feeding port 5 and coupling base intake port 3 respectively without need and in the absence of any other securing or locking mechanism, and only by friction between the mating surfaces. The high level of friction is achieved by either slightly tapering the walls of the mating surfaces or by providing longitudinal ridges on one of the mating surfaces. This type of coupling is easily detachable by slight rocking or twisting of the mating parts.

Figure 2:
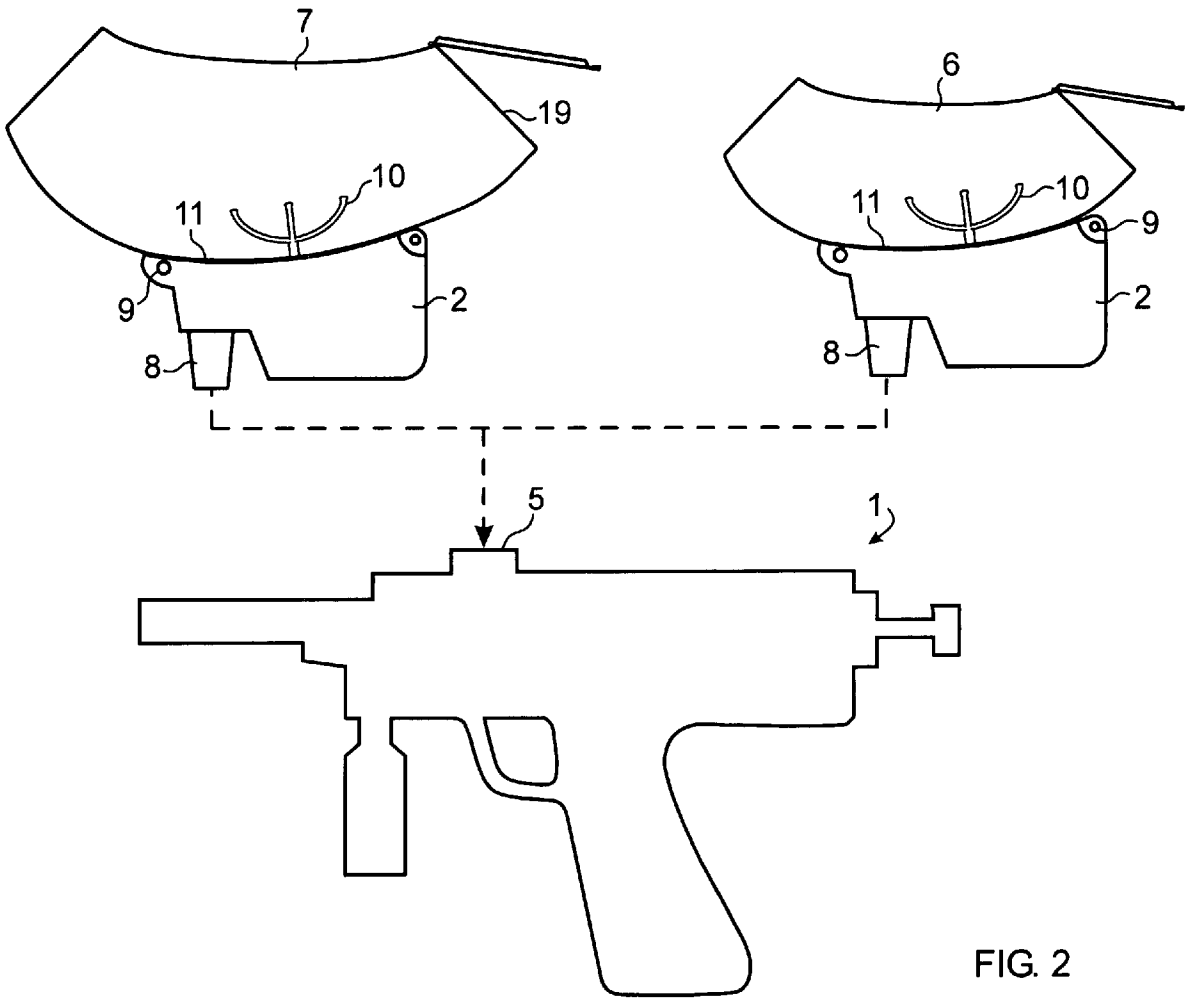
FIG. 2 is a schematic presentation of an alternate embodiment of the invention.

As illustrated in FIG. 2, a coupling base 2 may alternately be secured to each one of the different capacity magazines 6, 7. The commonly configured and dimensioned outlets 8 of the coupling bases can readily and quickly be led into the feeding port 5 of the gun. In this alternate embodiment of the invention, pins or screws 9 may be used to permanently secure each magazine to its coupling base. The magazines are substantially similar to the one disclosed in the second-mentioned of the above-referenced patents.

Figure 3:
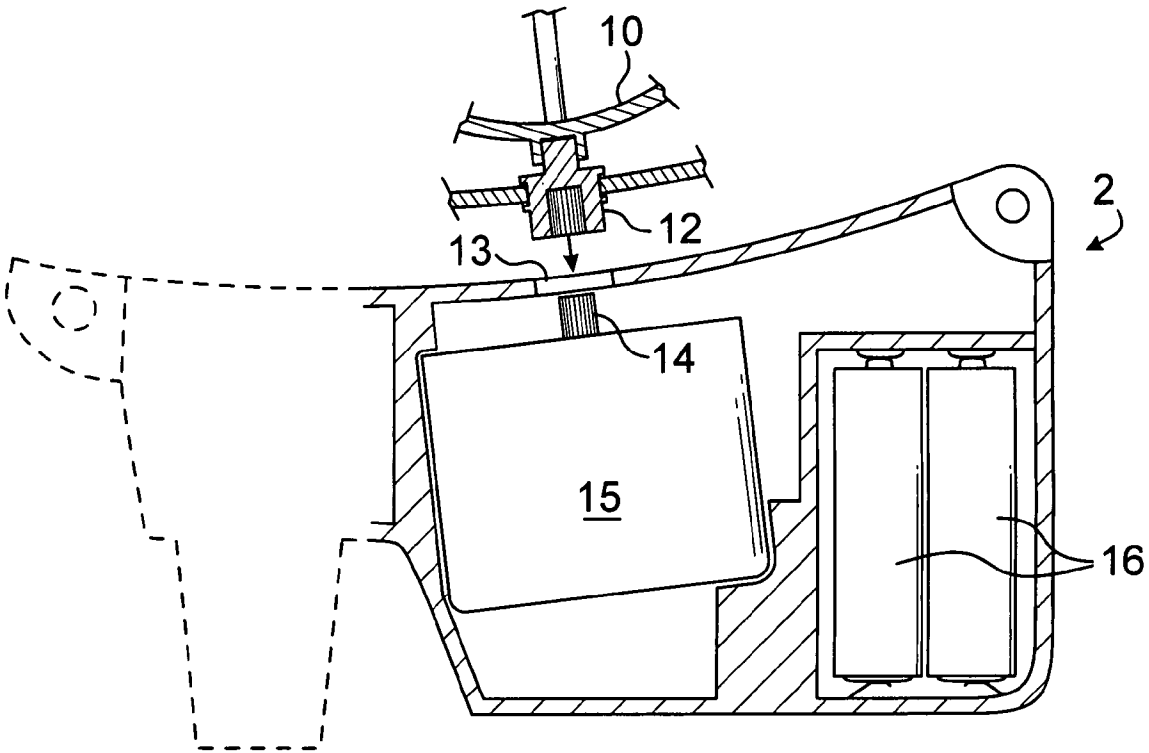
FIG. 3 is a cross-sectional view of the coupling base and agitator-driving mechanism.

Inside each magazine, a rotating agitator 10 located proximately to the opening 11 of the exit spout 8 has a drive bushing 12 which protrudes from the bottom of the magazine as illustrated in FIG. 3, and is shaped, dimensioned and positioned to penetrate an opening 13 in the roof of the coupling base and mate with the splined shaft 14 of an electrical motor 15 housed within the coupling base along with its power source consisting of a pair of batteries 16. It should be understood that another type of electromechanical mechanism such as a solenoid could be used in lieu of a motor to drive the agitator or any other type of projectile-feeding actuator.

Figure 4:
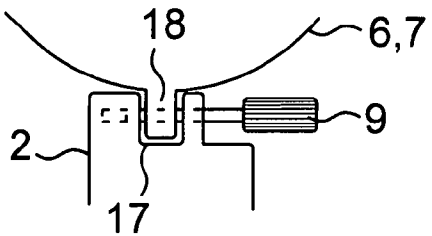
FIG. 4 is a detail view of a magazine-securing mechanism.

As shown in FIG. 4, the attachment mechanism between the magazine 6, 7 and the coupling base comprise a pin or screw 9 passing through a slot 17 at the forward and distal ends of the coupling base, and engaging a bored ear 18 integrally formed in the bottom of each magazine.

Each magazine 6, 7 forms a vessel with a single large aperture closed by a snapping hinge lid 20.

While the preferred embodiments of the invention have been described, modifications can be made and other embodiments may be devised without departing from the spirit of the invention and the scope of the appended claims.

What is claimed is:

1. A projectile holding and feeding device for a gun which comprises:

a coupler having an outlet shaped and dimensioned to mate with a gun projectile feeding port, and an intake port; and a plurality of projectile magazines of different capacities, each having an exit spout shaped and dimensioned to detachably mate with said intake port, each projectile magazine further defining a non-disabling loading aperture accessible while the projectile magazine is mated with the coupler.

2. The device of claim 1, wherein said coupler comprises an electro-mechanical driving mechanism having a shaft; and each of said magazines comprises a projectile feeding actuator having a bushing shaped, dimensioned and positioned to connect to said shaft when said magazine is mated with said coupler.

3. The device of claim 2, wherein said driving mechanism comprises a motor.

4. The device of claim 3, wherein said actuator comprises a spinning implement.

5. The device of claim 4 adapted to hold and feed paintballs into a paintball gun.

6. The device of claim 4 for holding and feeding paintballs to a paintball gun, wherein said spinning implement comprises a paintball agitator mounted proximately to said exit spout.

7. The device of claim 6, wherein said coupler further comprises an electrical power source.

8. The device of claim 2, wherein said outlet is shaped to securely connect to said feeding port by friction and in the absence of a locking mechanism.

9. The device of claim 2, wherein said exit spout is shaped to securely connect to said intake port by friction and in the absence of a locking mechanism.

10. The device of claim 2 which further comprises at least one manually actionable component for locking said magazine to said coupler.

11. The combination of a paintball marker including a projectile feeding port, a coupling base having an outlet shaped and dimensioned to mate with said feeding port and an intake port; and a plurality of paintball magazines of different holding capacities, each of said magazines having an exit spout shaped and dimensioned to detachably mate with said intake port, each projectile magazine further defining a non-disabling loading aperture accessible while the projectile magazine is mated with the coupler.

12. The combination of claim 11, wherein said coupling base comprises a motor having a shaft; and wherein each of said magazines comprises a paintball agitator having a bushing shaped, dimensioned and positioned to connect with said shaft when said magazine is mated with said coupling base.

13. The combination of claim 12, wherein said coupling base further comprises a source of electrical power for said motor.

14. The combination of claim 11, wherein said outlet is shaped to securely connect to said feeding port by friction and in the absence of a locking mechanism.

15. The device of claim 11, wherein said exit spout is shaped to securely connect to said intake port by friction and in the absence of a locking mechanism.

16. The device of claim 11 which further comprises at least one manually actionable component for locking said magazine to said coupler.

17. The combination of a paintball marker including a projectile feeding port and a plurality of paintball magazines of different holding capacities, each of said magazines including a vessel and a coupling base having an outlet shaped and dimensioned to mate with said feeding port, each paintball magazine further defining a non-disabling loading aperture accessible while the projectile magazine is mated with the coupler.

18. The combination of claim 17, wherein said coupling base comprises a motor; and said magazine comprises a paintball agitator driven by said motor.

19. The combination of claim 17, wherein said magazine has an outlet shaped to securely connect to said feeding port by friction and in the absence of a locking mechanism.

* * * * *